US005217314A

United States Patent [19]

Perruelle

[11] Patent Number: 5,217,314

[45] Date of Patent: Jun. 8, 1993

[54] CONNECTOR FOR ELONGATED ELEMENTS

[76] Inventor: Claude Perruelle, 7, Cote de la Tour, 69390 Millery, France

[21] Appl. No.: 892,119

[22] Filed: Jun. 2, 1992

[30] Foreign Application Priority Data

Apr. 4, 1990 [FR] France ..... 90 04769

[51] Int. Cl.[5] ..... E04G 7/02

[52] U.S. Cl. ..... 403/49; 403/190; 403/246; 52/638; 52/712; 182/179

[58] Field of Search ..... 403/49, 190–192, 403/187, 189, 256, 241, 246, 264, 174, 178; 182/179; 285/421; 52/638, 712, 715, 648.1; 248/225.1, 300; 211/192, 182

[56] References Cited

U.S. PATENT DOCUMENTS

| | | | |
|---|---|---|---|
| 1,463,353 | 7/1923 | White | 403/399 |
| 1,805,742 | 5/1931 | Reynolds | 248/300 X |
| 2,743,657 | 5/1956 | Kriegbaum | 403/405.1 X |
| 2,973,982 | 3/1961 | Elting et al. | 403/189 X |
| 4,044,523 | 8/1977 | Layher | 52/638 |
| 4,348,128 | 9/1982 | Gostling | 403/49 |
| 4,603,756 | 8/1986 | Layher | 182/178 |
| 4,867,274 | 9/1989 | Langer | 182/179 |
| 4,958,702 | 9/1990 | Langer | 403/49 X |
| 5,127,757 | 7/1992 | Langer | 403/49 |
| 5,143,471 | 9/1992 | Spinner | 403/246 |

FOREIGN PATENT DOCUMENTS

| | | |
|---|---|---|
| 289825 | 9/1988 | European Pat. Off. . |
| 2288199 | 5/1976 | France . |
| 2520482 | 7/1983 | France . |
| 2155140 | 9/1985 | United Kingdom . |

*Primary Examiner*—Randolph A. Reese
*Assistant Examiner*—Harry C. Kim
*Attorney, Agent, or Firm*—Oliff & Berridge

[57] ABSTRACT

The connector is of the type attached to one end of a first element and having a throat designed to allow engagement around a matching retaining collar mounted on a second element which is to be attached to the first element. The cross-section of the connector has an M-shaped profile having two central bars separated from side bars by empty spaces. The central bars delimit between them the throat and the side bars allow the connector to be attached to the elongated first element to which it is fitted. The present connection is particularly suited for erecting scaffolding.

11 Claims, 2 Drawing Sheets

CONNECTOR FOR ELONGATED ELEMENTS

BACKGROUND OF THE INVENTION

The present invention relates to a connector for elongated elements. This connector is, in general, designed to equip any elongated element, when assembled to other identical or similar elements, with a bearing structure. In particular, it is designed for elements that allow a scaffolding to be erected.

It is known that two scaffolding elements can be assembled by mutual engagement of matching retaining elements and locking thereof.

One connector assembly is formed by means of collars coaxially attached to risers and matching assembly parts integral with ends of cross members, each having a throat allowing engagement around part of the collar and having holes provided to align themselves, when this engagement is effected, with a hole in the collar so as to allow forced introduction through them of a wedge-shaped locking key, one edge of which abuts the connector and the other edge abuts the collar, to lock the connector onto the collar when the key is driven in.

Currently known connectors are made of metal and cast at a foundry. They have the drawbacks of being very heavy, difficult to manufacture, expensive, and requiring long manufacturing times. Moreover, their heavy weight limits their dimensions so that, in cases where they are designed to abut the wall of the riser after assembly, their surfaces abutting the wall are inadequate to eliminate all play between the risers and the cross members when the scaffolding is being constructed, entailing the risk of damaging the connectors and the collars in addition to instability of the scaffolding.

A goal of the present invention is to overcome these drawbacks.

SUMMARY OF THE INVENTION

A connector of the invention is of the type attached to one end of an element and having a throat designed to permit its engagement around a matching retaining element carried by another element which is to be attached to the element to which the connector is attached. It is characterized by having a part that is M-shaped in cross section, whose two central bars, which are separated from side bars by empty spaces, delimit between them the throat and whose side bars allow the connector to be attached to the elongated element to which it is fitted.

Because of its empty spaces, the connector according to the invention is particularly light. It is also made very simply, rapidly, and inexpensively, particularly when it comprises a metal strip folded such as to delimit its bars, according to a preferred embodiment.

BRIEF DESCRIPTION OF THE DRAWINGS

The invention will be thoroughly understood with the aid of the description hereinbelow which refers to the schematic drawings representing a preferred embodiment of the connector according to the invention as a nonlimiting example, wherein.

DETAILED DESCRIPTION OF PREFERRED EMBODIMENTS

Preferably, the connector has two plane parts located in the same plane and oriented perpendicular to the throat, on both sides of which they extend considerably, the depth of the throat being chosen such that, in the assembled position of the connector and its aforesaid matching retaining element, the plane parts abut the wall of the elongated element bearing the matching retaining element.

These plane parts constitute broad bearing zones of the connector, able to eliminate any play between the elements when they are assembled. Because of the lightness of the connector according to the invention, the length of these bearing zones may be more than double that of the bearing zones that existing connectors comprise, so that the scaffolding can be rendered fully stable. The side bars play the role of cross braces for these plane parts and allow the forces transmitted to the connector to be distributed.

Advantageously, the connector is designed to be attached to an elongated element which is hollow on the inside and parts of the central bars that delimit the bottom of the throat are shaped to be engaged in a cavity of the element when the connector is attached thereto, the part being prolonged laterally by shoulders designed to abut the edge of the cavity in the element.

This shape allows supplementary points of attachment of the connector to the element at its central bars. These bars, which can be made to withstand substantial stresses, are thus perfectly joined to the element.

Preferably, the connector is fitted to the end of a cross member (first element) and the lateral edges of its bars converge on the side opposite the cross member. Such connectors allow several cross members to be attached to one and the same retaining element which, attached coaxially to one riser (second element) of the scaffolding, constitutes the matching retaining element of the connectors, which retention can be accomplished with small angles between the cross members.

Moreover, according to a preferred embodiment of the invention, the connector has holes which, when the connector engages the matching retaining element, coincide with a hole in the latter element such as to permit introduction by force through them of a wedge-shaped locking key, one edge of which abuts the connector and the other edge abuts the element to lock the connector onto the element when the key is driven in.

Advantageously, the key has, in the vicinity of its narrower end, a projecting nipple forming a pin and a hole, provided in the side bar of the connector located on the side opposite the nipple, is designed to allow the key but not the nipple to pass, while the other holes are designed to allow both the key and the nipple to pass. Thus, the key cannot be separated from the connector and always remains in place.

Figure 1:
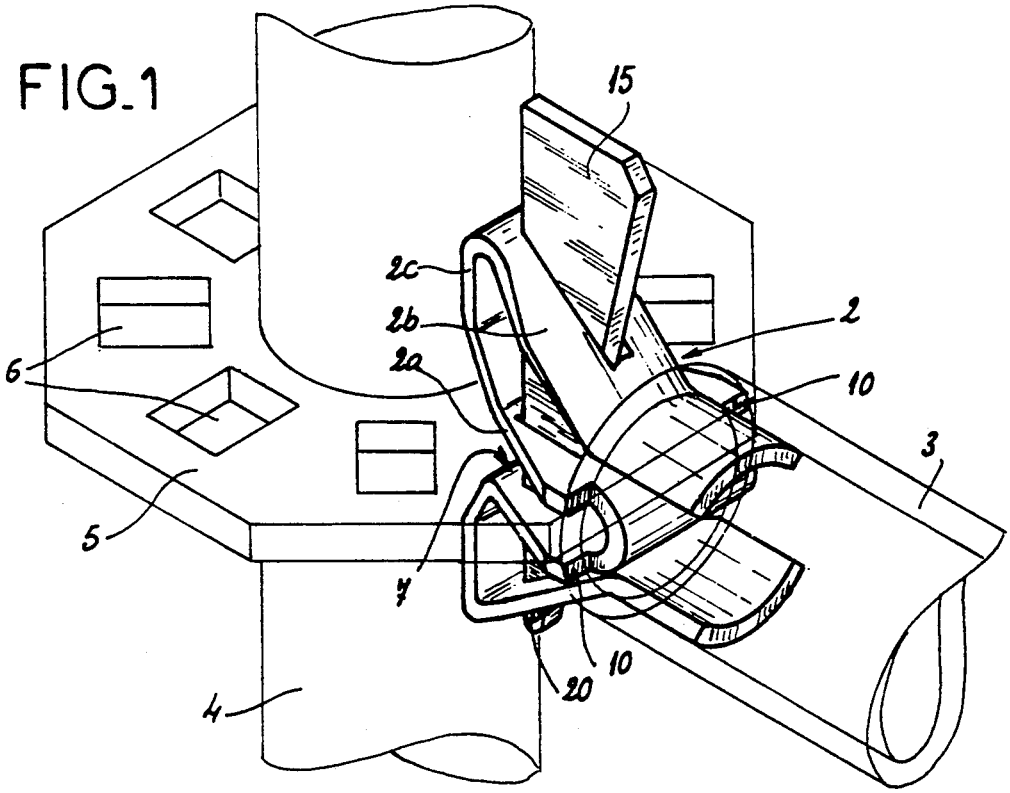
FIG. 1 is a perspective view of a connector according to the present invention.

FIG. 1 shows, in heavy lines, a connector 2 and, in thin lines fictitiously represented as being transparent, a tubular metal cross member 3 (first element) to which is attached connector 2, as well as a riser 4 (second element), also tubular and metallic, to which is attached coaxially a collar 5, serving as a retaining element, provided with holes 6 and intended for adaptation of connector 2 for assembly of cross member 3 and riser 4. To allow this adaptation, connector 2 has a throat 7 engaged around collar 5.

Figure 3:
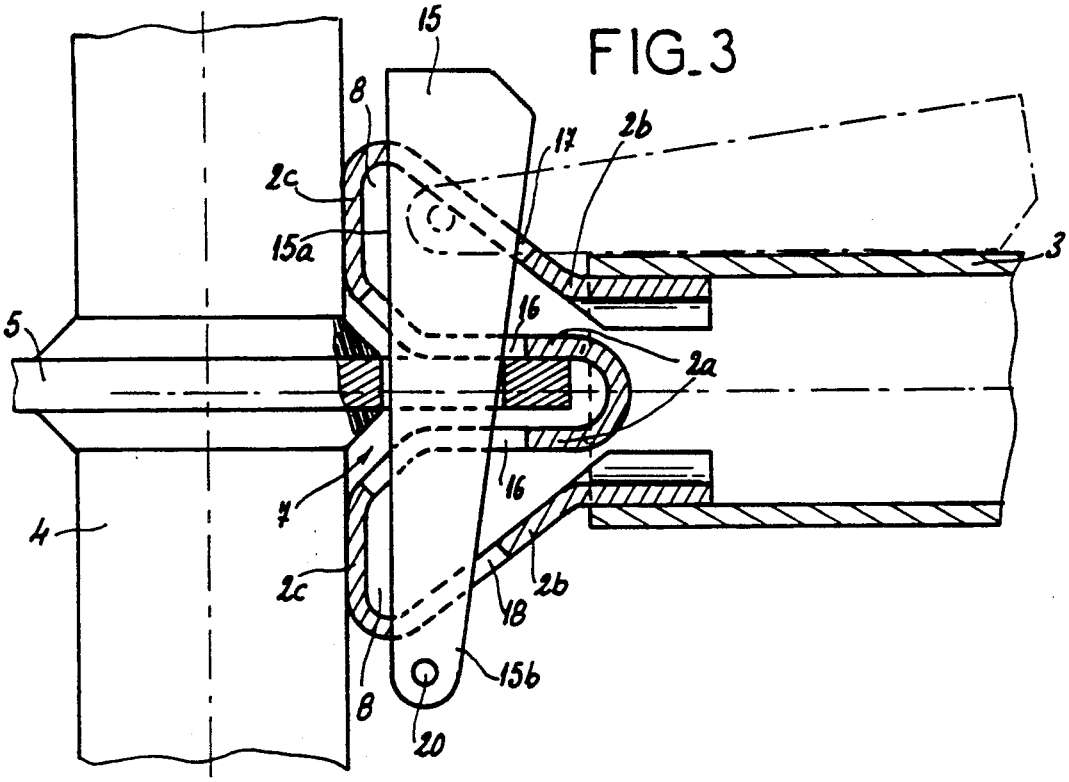
FIG. 3 is a partial cross-sectional view of the connector of FIG. 1.

As can be seen more particularly from FIG. 3, connector 2 has an M-shaped profile in cross section whose two central bars 2a delimit between them throat 7 and whose side bars 2b, which are oblique, appropriately bent lengthwise at their free ends, allow connector 2 to be joined to cross member 3 by welding.

Connector 2 has two plane parts 2c located in one plane and oriented perpendicular to throat 7, to both sides of which they extend considerably. The depth of the throat is chosen so that, in the assembled position of connector 2 and collar 5, plane parts 2c can press against the wall of riser 4. Central bars 2a delimit, with side bars 2b and parts 2c, empty spaces 8.

Figure 4:
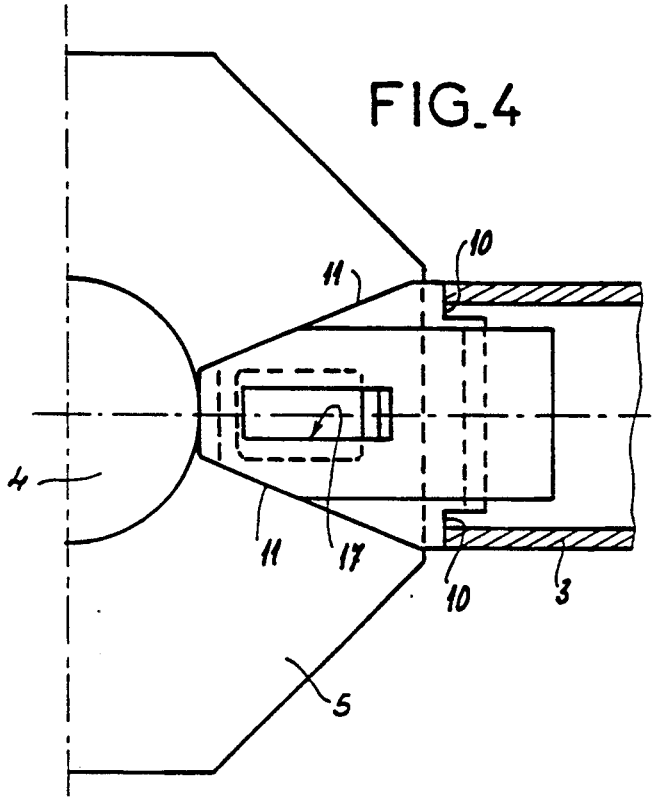
FIG. 4 is a top view of the connector of FIG. 1.

The parts of bars 2a constituting the bottom of throat 7 are engaged in a cavity of cross member 3. These parts are extended laterally by shoulders 10 which abut the edge of the cavity of cross member 3, to which they are welded. Lateral edges 11 of bars 2a (FIG. 4) and part of the edges of bars 2b converge on the side opposite cross member 3.

Moreover, connector 2 is equipped with a key 15 designed to be engaged through vertically aligned holes 16, 17, and 18 provided in bars 2a and 2b, as well as through hole 6 with which they coincide, when connector 2 engages collar 5. Key 15 is wedge-shaped and one of its edges, 15a, abuts the edges of holes 17 and 18 facing riser 4 while the other edge, 15b, abuts the aperture of hole 6 during the driving in of key 15.

Key 15 is equipped with a nipple 20 which projects laterally at its end located on the side opposite side bar 2b in which hole 17 is provided, the width of this hole being such as to permit passage and sliding of key 15, but not passage of nipple 20, while the widths of holes 16 and 18 are such as to permit passage through them of both key 15 and nipple 20.

Figure 2:
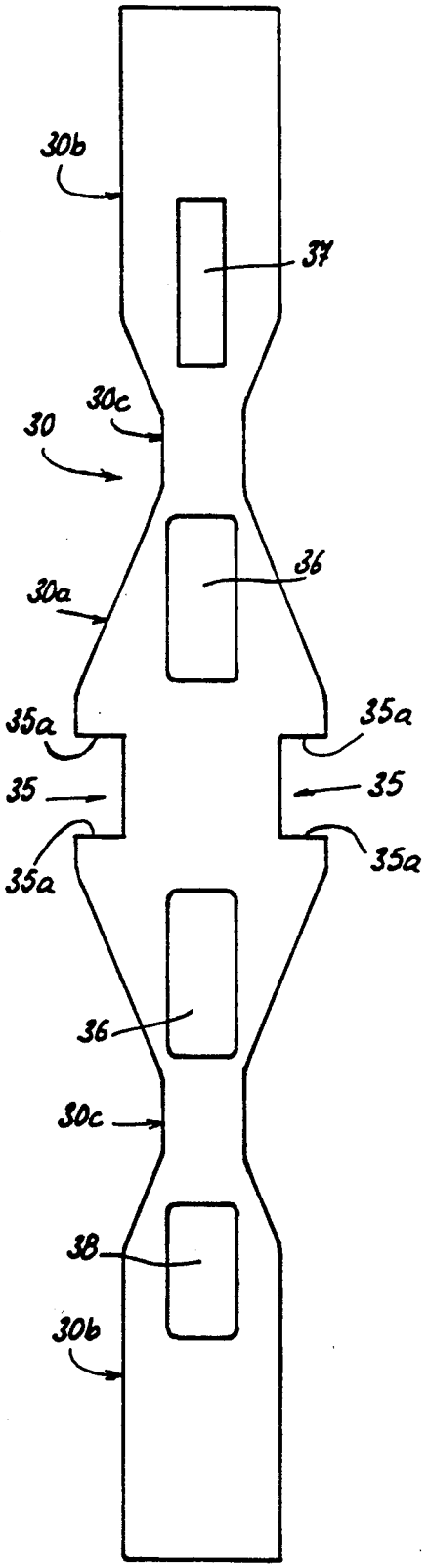
FIG. 2 is a top view of a cut metal strip from which the connector of FIG. 1 is obtained.

FIG. 2 shows a metal strip 30 which is symmetrical on both sides of its lengthwise and crosswise median axes, except for the fact that, of the four holes 36, 37, and 38 provided in it, holes 37 and 38 differ in their dimensions.

Strip 30 has a center part 30a and end parts 30b separated from the center part by intermediate parts 30c. Part 30a has holes 36 and, in its middle, two rectangular notches 35 provided in its lengthwise edges. On both sides of these notches 35, edges of the part 30a are oblique and converge toward each other in the direction of parts 30c then diverge beyond these parts at the same angle. One of parts 30b has hole 37 and the other, hole 38.

Strip 30 is designed to be folded to allow connector 2 to be obtained. It can clearly be seen from FIGS. 1, 3 and 4 that part 30a of strip 30, after folding back on itself about its median transverse axis, constitutes the center bars 2a of connector 2 and the bottom of throat 7, while its parts 30b constitute bars 2b and its parts 30c, plane parts 2c. Holes 36, 37, and 38 constitute respectively holes 16, 17, and 18 and the oblique edges of strip 30 constitute the converging side edges 11 of bars 2a and 2b of connector 2. Edges 35a of notches 35 allow shoulders 10 to be created.

In practice, the forceful driving in of key 15 allows connector 2 to be locked onto collar 5 and surfaces 2c to be pressed against the wall of riser 4. Key 15 cannot be separated from connector 2 because of nipple 20 and hole 17, and remains in place, whereby key 15 can be placed in a waiting position along cross member 3 because of the shape of connector 2, as shown in FIG. 3 in dotdashed lines, a position that facilitates its later engagement through connector 2 and facilitates storage and stacking of cross members 3.

Parts 2c constitute broad bearing zones of connector 2, able to eliminate all play between cross member 3 and riser 4 when they are assembled. Bars 2b, which are oblique, act as cross braces for parts 2c and allow the forces to which connector 2 is subjected to be distributed.

Shoulders 10 provide additional attachment points for connector 2 to cross member 3, in order to perfectly join center bars 2a to the connector.

The oblique converging edges of connector 2 allow several cross members 3 to be mounted on collar 5 with minimum angles between them of 45°.

Because it has been obtained from strip 30, and because of its free volumes (empty spaces) 8, the connector 2 is simple to make and particularly light, while being strong because of its various attachment points.

What is claimed is:

1. A locking system for connecting first and second elongated elements, comprising:

a connector attachable to the first elongated element, said connector having a M-shaped cross-section formed by two spaced central bars and two spaced side bars, said two spaced central bars each having two ends, said central bars being connected to one another at one end of each said central bar to form a throat therebetween, said two side bars being connected to the other end of each said central bar, said two central bars being spaced from said side bars, said side bars extending toward said first elongated element for attachment therewith; and a matching retaining element carried by the second elongated element which is to be attached to said first element, said retaining element being partially extendable within said throat.

2. The locking system according to claim 1, wherein the connector comprises a folded metal strip.

3. The locking system according to claim 1, wherein the connector has two plane parts located in a single plane and oriented at an angle with respect to the throat and extending a predetermined distance on both sides of the throat, said plane parts connecting said spaced central bars to said spaced side bars, the throat having a depth being chosen such that, in an assembled position of the connector and the matching retaining element, the plane parts abut a wall of the second element bearing the matching retaining element.

4. The locking system according to claim 1, wherein parts of the central bars of the connector that delimit the throat are shaped to be engaged within a cavity on the one end of the first element when the connector is attached thereto, the parts having shoulders which extend laterally to abut the one end of the first element.

5. The locking system according to claim 1, wherein the connector includes lateral edges, on the side bars and the central bars, which converge opposite the first element when the connector is fitted to the one end of the first element.

6. The locking system according to claim 1, wherein the connector has a plurality of aligned holes which, when the connector engages the matching retaining element, coincide with a hole in the retaining element such as to permit introduction by force through the plurality of aligned holes and the hole in the retaining element of a wedge-shaped locking key, one edge of the key abutting the connector and another edge abutting the retaining element to lock the connector onto the retaining element when the key is introduced through the aligned holes.

7. The locking system according to claim 6, wherein said key has a wide end which tapers to a narrower end and a projecting nipple which forms a pin near the narrower end, and one of the plurality of aligned holes of said connector is sized to allow the narrower end of said key passage therethrough while not permitting the nipple passage therethrough, said one of said plurality of aligned holes movably retaining said key within said connector to prevent complete removal of said key.

8. The locking system according to claim 7, wherein said key is positionable in a withdrawn position wherein an edge of said key extends parallel with a longitudinal axis of the first element, the narrower end of said key being movably retained in said connector by the one of said plurality of aligned holes and said projecting nipple.

9. The locking system according to claim 1, wherein said central bars are located between said spaced side bars.

10. The locking system according to claim 1, wherein said central bars are substantially parallel to one another.

11. A locking system for connecting first and second elongated elements, comprising:

a connector attachable to the first elongated element, said connector having a M-shaped cross-section formed by two spaced central bars and two spaced side bars, said two spaced central bars each having two ends, said central bars being connected to one another at one end of each said central bar to form a throat therebetween, said two side bars being connected to the other end of each said central bar, said two central bars being spaced from said side bars, said side bars obliquely converging toward said first elongated element for attachment therewith; and a matching retaining element carried by the second elongated element which is to be attached to said first element, said retaining element being partially extendable within said throat.

* * * * *